United States Patent [19]

Redick

[11] 4,124,954

[45] Nov. 14, 1978

[54] SELF-CLOSING GATE

[76] Inventor: Daniel J. Redick, 174 Briscoe St., London, Ontario, Canada, N6C 1X3

[21] Appl. No.: 790,950

[22] Filed: Apr. 26, 1977

[30] Foreign Application Priority Data

Jun. 18, 1976 [CA] Canada ..... 255254

[51] Int. Cl.[2] ..... E05D 7/06

[52] U.S. Cl. ..... 49/236; 49/381

[58] Field of Search ..... 49/381, 236, 240, 242–244

[56] References Cited

U.S. PATENT DOCUMENTS

| | | | |
|---|---|---|---|
| 1,283,359 | 10/1918 | Thomson | 49/381 |
| 2,538,470 | 1/1951 | Peeples | 49/236 X |
| 4,047,332 | 9/1977 | Benoit | 49/236 |

*Primary Examiner*—Kenneth Downey

*Attorney, Agent, or Firm*—Murray and Whisenhunt

[57] ABSTRACT

A self-closing gate incorporating a child-proof latch designed for constructing enclosures restricting accessibility thereto by small children. The self-closing gate comprises a gate, first and second vertically extending gate posts positioned at each side of the gate, and upper and lower gate hinges extending between the first gate post and one side of the gate. The upper and lower gate hinges are non-vertically aligned so as to provide a self-closing action to the gate. A gate latch extends between the second gate post and the opposite side of the gate, which by means of its design, restricts the gate to opening in one direction only, thus allowing access to the latch only by reaching over the gate.

8 Claims, 12 Drawing Figures

SELF-CLOSING GATE

This invention is directed to a self-closing gate. More particularly, this invention is directed to a gate which self closes by means of the force of gravity without the aid of springs or other gate closing means.

BACKGROUND OF THE INVENTION

Many municipalities have legislation requiring that private swimming pools be enclosed by fences and gates built according to prescribed specifications. Many such municipalities require that any gate in such fence constructions must be of the self-closing self-latching type, must be reliable in operation and must open in one direction only. The underlying objective of the municipal legislation relating to private swimming pools is to make sure that such pools are safely enclosed so that accidental drownings do not occur.

Usually, an expensive and complicated form of gate is required in order to meet the specifications prescribed by the municipality for enclosing swimming pools.

I have invented a gate which is of relatively simple inexpensive construction and yet will meet the requirements and specifications of most municipalities. The gate I have invented will self close by utilizing the force of gravity rather than having to rely on mechanical closing means such as springs and the like. The advantage of such a construction is that the cost of the gate and related components is reduced because a separate spring mechanism is eliminated.

SUMMARY OF THE INVENTION

My construction of gate consists of a gate, which is positioned between two gate posts, and has on one side of the gate, two hinges secured to one of the gate posts. On the other side, opposite the gate hinges, the gate has a latch which, by means of its construction, can tolerate variations in the relative positions of the two gate posts and the gate. The latch, because of its construction, is normally openable only from one side. Tall people (adults) standing on the opposite side of the gate can open the latch by reaching over the top of the gate. The gate therefore has a built in safety factor because it cannot be opened by children from one side.

The gate opens in one direction only, and when opened, is induced to return to its closed position by the force of gravity. The gate therefore always closes thereby adding to its safety advantages. This is done by having the upper and lower hinges of the gate positioned relative to one another so that their respective pivots of rotation are not in vertical alignment. The pivot of rotation for the lower hinge is set outwardly in the direction of the gate opening in comparison with the pivot of rotation of the upper gate hinge. As a consequence, when the gate is opened, the gate by reason of the staggered vertical alignment of the lower and upper gate hinges builds up a residual force due to having to overcome gravity slightly, and hence, when the gate is released, it returns to its closed position by utilizing the force of gravity.

The upper and lower hinges are constructed to provide a certain amount of universal movement so that the hinges do not bind.

The invention is directed to a self-closing gate construction comprising: a gate, first and second vertically extending gate posts positioned at each side of the gate, upper and lower gate hinges extending between the first gate post and one side of the gate, a gate latch extending between the second gate post and the side of the gate opposite the side of the gate that has the upper and lower gate hinges, the gate being capable of opening in one direction only, and not beyond a point where the gate will not self close, and the upper and lower gate hinges being non-vertically aligned with one another so as to provide a self-closing action to the gate, when the gate has been opened.

The upper gate hinge can consist of a post collar securing a hinge pin extending upwardly, and an eye bolt which extends through the frame of the gate and fits over and rides on the hinge pin. The lower gate hinge can consist of a post collar securing a hinge pin extending downwardly, an eye bolt which extends through the frame of the gate and fits on and rides about the hinge pin.

The lower hinge eye bolt can be of greater length than the upper hinge eye bolt. The distance that the lower hinge eye bolt extends from the gate can be adjusted. The upper hinge pin can be positioned so that it is aligned between the gate post and the gate, and the lower hinge pin can be positioned so that it is not aligned between the gate post and the gate and is out of alignment in the direction in which the gate opens.

The gate latch can consist of a gate finger connected to the gate and extending toward the gate post, a latch collar, and a pivot lock, the gate finger fitting into the latch collar and being secured by the pivot lock when the gate is in a closed position. The gate finger can be elongated in shape and can be pivotally secured to the gate in a vertical direction so as to accommodate variations in relative height and distance between the gate and the gate post which bears thereon the latching mechanism.

DRAWINGS

DETAILED DESCRIPTION OF THE INVENTION

Figure 1:
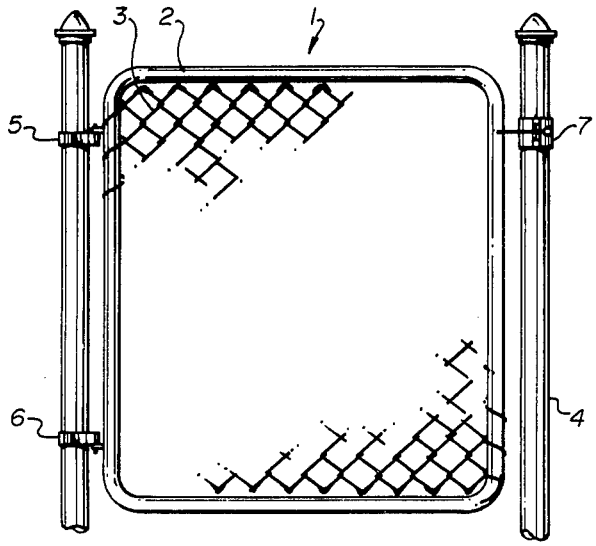
FIG. 1 is a front view showing the self-closing gate positioned between two gate posts.

Referring to FIG. 1, the gate 1 is constructed of gate frame 2 and gate mesh 3. The gate frame 2 is strong tubular steel which provides a generally square shaped border for the gate mesh 3. The gate mesh 3 is constructed of strong intertwined steel wire to provide an overall web structure.

The gate 1 is positioned between two gate posts 4. These two gate posts 4 are constructed of tubular steel and are set in a vertical position in the ground. The two gate posts 4 are spaced apart at a distance approximately 2 inches greater than the width of the gate 1. One of the gate posts 4 has fastened thereto an upper gate hinge 5 and a lower gate hinge 6.

The gate post 4 located opposite the gate post 4 with the two gate hinges thereon has secured thereto a gate latch 7.

Figure 2:
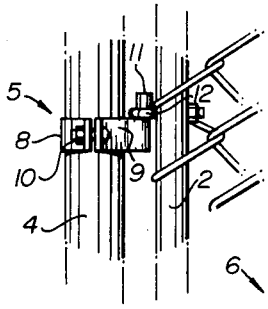
FIG. 2 illustrates a detailed view of the upper gate hinge.

Referring to FIG. 2, the upper gate hinge 5 is constructed of a post collar back 8 and a post collar front 9, which are fastened together by means of post collar nuts and bolts 10 around gate post 4. The post collar front 9 has mounted thereon an upwardly extending hinge pin 11. Hinge pin 11 provides a pivoting location on the upper hinge assembly for the gate 1. An eye bolt 12 penetrates through gate frame 2 and is secured thereto by means of a nut. The "eye" of the eye bolt fits over hinge pin 11 and thereby provides the pivoting point for the gate about the post 4. The eye and pin construction provide a certain amount of universal movement and thereby eliminate any tendency for the hinge to bind.

Figure 3:
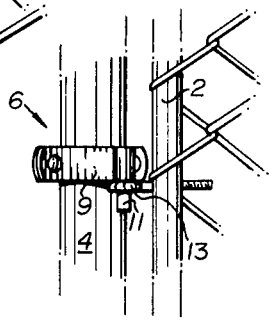
FIG. 3 represents a detailed view of the lower gate hinge.

Referring to FIG. 3, the lower gate hinge 6 is constructed in similar form to the upper gate hinge 5, and consists of a post collar back 8 and a post collar front 9 which are held together and about gate post 4 by means of post collar nuts and bolts 10.

A hinge pin 11 is secured to the post collar front 9. However, unlike hinge pin 11 for the upper gate hinge 5, pin 11 of the lower gate hinge 6 extends downwardly.

An eye bolt 13 extends through and is secured to the lower part of gate frame 2 by means of two locking nuts. Eye bolt 13 is positioned about the lower hinge pin 11 and thereby provides the pivotal location for the lower gate hinge assembly 6.

Figure 4:
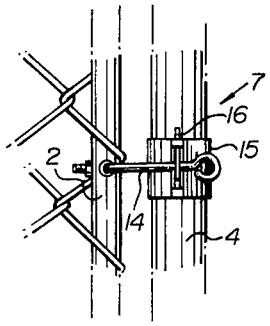
FIG. 4 represents a detailed view of the gate latch.

Referring to FIG. 4, the gate latch assembly 7 consists of a gate finger 14, which is secured into gate frame 2 on the side opposite the two hinges 5 and 6. The gate finger 14 extends through latch collar 15, which is bolted about gate post 4. Latch collar 15 has mounted therein a pivot lock 16, which can be raised and lowered to fit about gate finger 14, thereby providing a locking action for the gate.

Gate finger 14, by virtue of its construction, can be rotated upwardly and downwardly in relation to gate frame 2, and secured by appropriate lock nuts. By being rotatable, gate finger 14 will accommodate variations in relative heights of gate frame 2 and gate post 4. Also, since the gate finger 14 is fairly long, it will accommodate varying distances between the gate frame 2 and the gate post 4. Variations in the relative heights and spaced relationships of the gate components can occur when the gate is assembled at a particular location, or throughout the year, and over a period of time, due to ground settling from frost or other ground shifting phenomenon.

The gate latch assembly 7 is of relatively simple sturdy construction and provides a very efficient and reliable gate latching construction.

Figure 5:
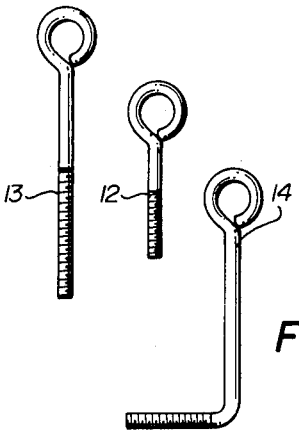
FIG. 5 illustrates two eye bolts and a gate finger.

FIG. 5 shows detailed views of the lower hinge eye bolt 13, upper hinge eye bolt 12, and the gate finger 14.

Figure 6:
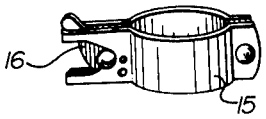
FIG. 6 illustrates a gate latch collar and a pivot lock.

FIG. 6 illustrates a detailed view of the locking portion of the gate latch assembly 7. The locking portion consists of a latch collar 15, which fits about and is secured to gate post 4, and has constructed therein a pivot lock 16. This pivot lock 16 will raise itself when impinged by gate finger 14, when the gate 1 is closing itself, and will then drop and lock itself about gate finger 14 when gate finger 14 has reached its locking position.

Figure 7:
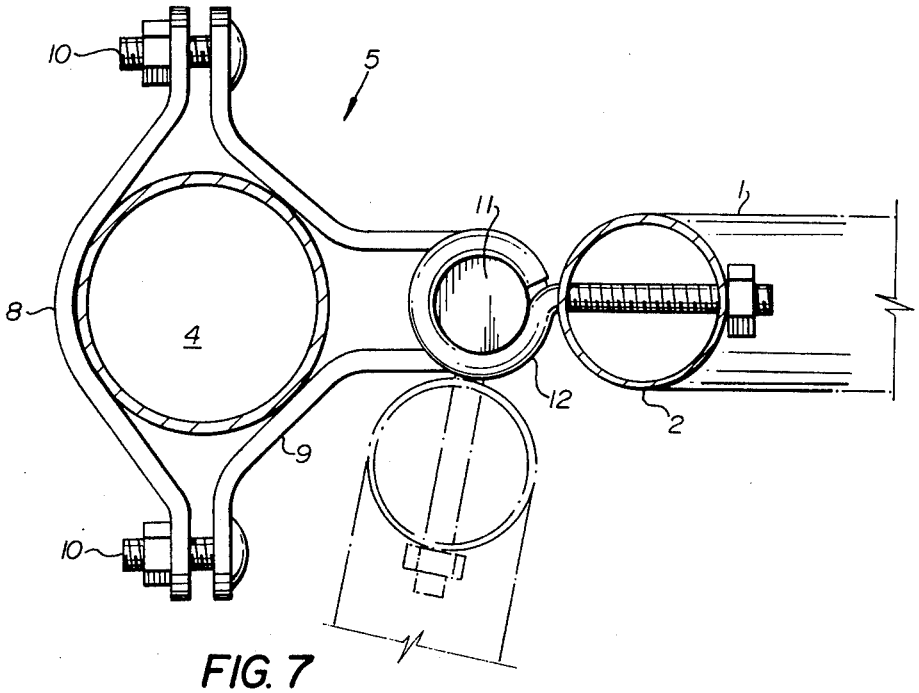
FIG. 7 illustrates a vertical view of the upper gate hinge assembly.

Referring to FIG. 7, upper gate hinge assembly 5 consists of a post collar back 8, and a post collar front 9 which are together bolted to gate post 4 by means of two post collar nuts and bolts 10. The horizontal setting of post collars 8 and 9 about gate post 4 can be varied by rotating these collars about gate post 4. Hinge pin 11 is positioned so that it extends towards the gate frame 2 and has mounted thereon upper hinge eye bolt 12, which extends through gate frame 2 and is secured thereto by a lock nut.

The dotted lines in FIG. 7 illustrate the position of the upper gate hinge assembly 5 when the gate frame 2 is in the open position.

Figure 8:
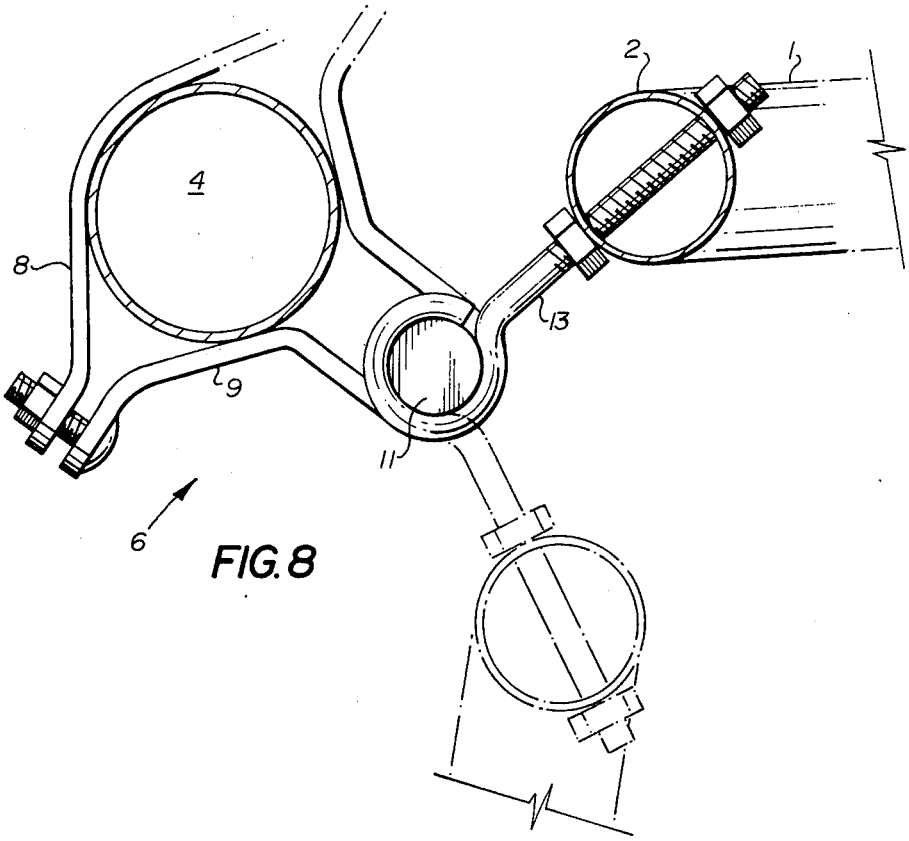
FIG. 8 illustrates a vertical view of the lower gate hinge assembly.

Referring to FIG. 8, which illustrates in detail the lower gate hinge assembly 6, a post collar back 8 and a post collar front 9 are positioned about gate post 4, and are secured together by means of two post collar nuts and bolts 10. As with the upper gate hinge assembly 5, post collar front 9 has secured thereto a hinge pin 11. Hinge pin 11, as can be seen in FIG. 3, extends downwardly rather than upwardly. If both the upper and lower pins 11 extended upwardly, the gate could be stolen simply by lifting it off the two upwardly extending pins 11. Having the lower pin 11 extend downwardly provides protection against vandalism because it is not possible to lift the gate off the respective post collar pins 11 of the upper and lower gate hinge assemblies 5 and 6.

As can be seen in FIG. 8, post collar back 8 and front 9 are positioned about gate post 4 in a manner that causes lower post collar pin 11 to be out of vertical alignment with upper post collar pin 11, as shown in FIG. 7. Further, lower hinge eye bolt 13 is longer in length that upper hinge eye bolt 12. This enables the actual gate frame 2 to remain in vertical alignment, notwithstanding that the upwardly extending pivoting axis is not in vertical alignment by reason that the lower hinge pin 11 is out of vertical alignment with the upper hinge pin 11.

When gate 1 is opened (towards the bottom of the page as seen in dotted lines in FIGS. 7 and 8) the lower part of the gate 1 must travel through a greater distance than the upper part of the gate 1. By doing so, the gate as it is opened is forced to tilt slightly upwardly. The gate as it is opened thereby builds up residual energy because it is, in effect, being raised against gravity. When the gate is released, it succumbs to the force of gravity and returns to its normal closed position.

The distance between the upper and lower hinge assemblies in relation to the overall size of the gate directly effects the amount of residual energy that the gate builds up within itself when the gate is opened, and determines the force and speed by which the gate will close itself. As can be seen in FIG. 8, the length of thread on lower hinge eye bolt 13 permits the two lock nuts to be tightened about gate frame 2 at a range of positions thereby providing a measure of adjustability in positioning the gate frame 2 parallel to the gate post 4 in the closed position.

Figure 9:
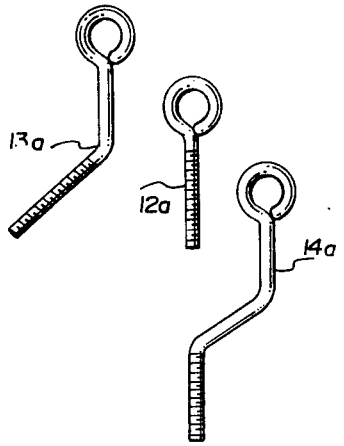
FIG. 9 illustrates two alternative constructions of eye bolts and an alternative construction of gate finger.

FIG. 9 illustrates three alternative constructions of eye bolts and gate finger. Upper hinge eye bolt 12*a* is 1 inch longer than previous eye bolt 12 and completely threaded allowing the "eye" of the eye bolt 12*a* to be mounted at a range of distances from the gate frame 2.

Lower hinge eye bolt 13*a* has a threaded portion 1 inch longer than lower hinge eye bolt 13 and includes therein immediately ahead of the thread a 55° bend. This construction allows lower hinge eye bolt 13*a* to bisect the gate frame 2 at the same angle as the upper hinge eye bolt 12*a* and permits the "eye" of the lower hinge eye bolt 13*a* to be mounted at a range of distances from the gate frame 2.

Gate finger 14*a* has a threaded portion which is 1 inch longer than in gate finger 14. Further, gate finger 14*a* has therein two equal and compensating bends of 60°. One bend is immediately in front of the thread and the second bend is approximately midway between the "eye" of the gate finger 14*a* and the 60° bend immediately ahead of the thread. This construction of gate finger 14*a* enables the gate finger 14*a* to bisect the gate frame 2 at the same angle as the upper and lower hinge eye bolts 12*a* and 13*a* respectively and permits the same range of mounting distances.

Figure 10:
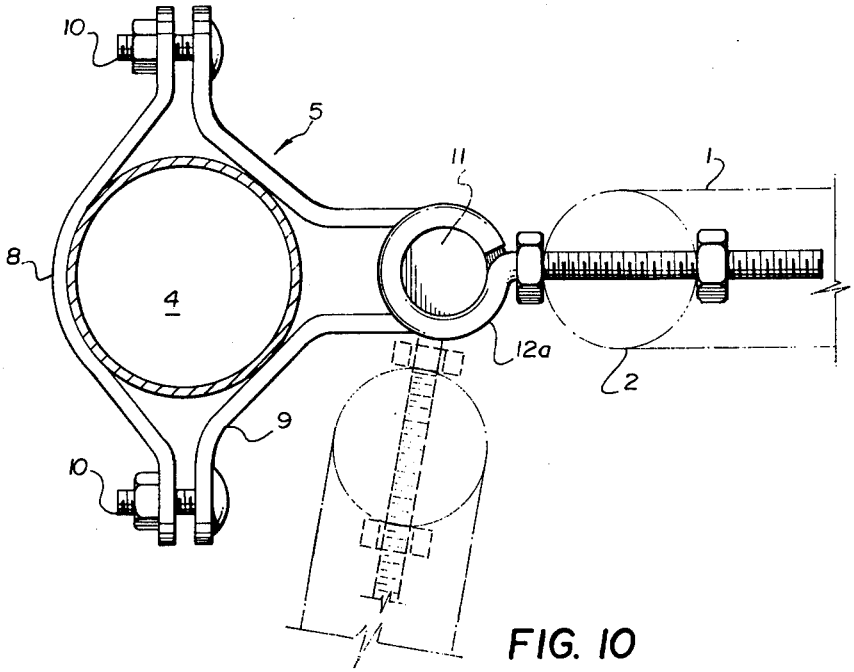
FIG. 10 illustrates a vertical view of an alternative construction of upper gate hinge assembly.
Figure 11:
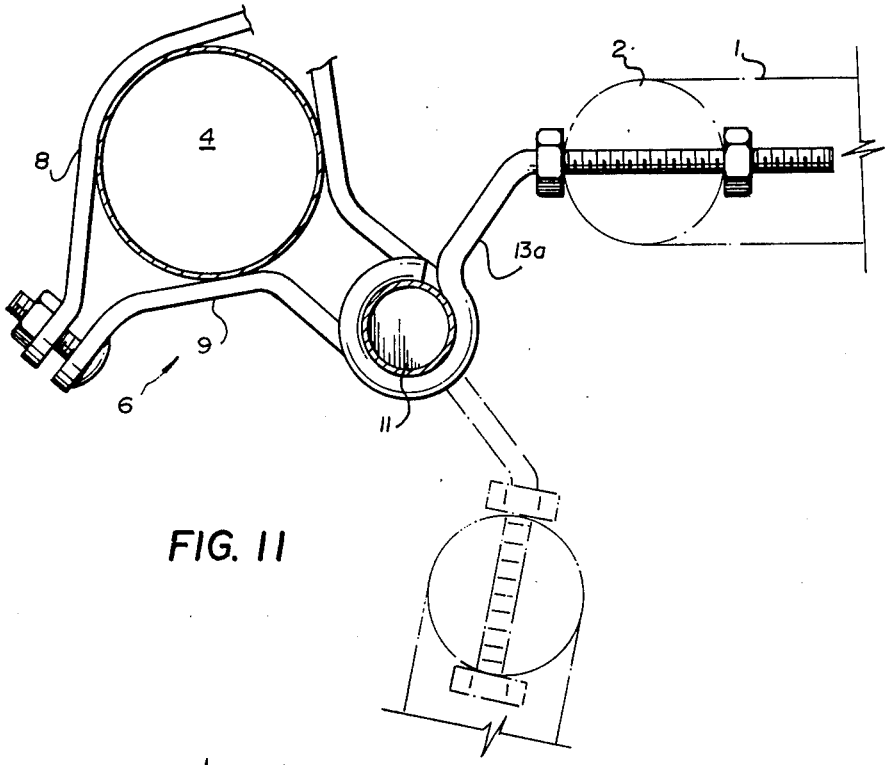
FIG. 11 illustrates a vertical view of an alternative construction of lower gate hinge assembly.
Figure 12:
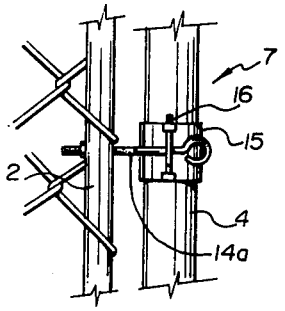
FIG. 12 represents a detailed view of an alternative construction of the gate latch.

FIG. 10 shows a vertical view of how the upper gate hinge assembly appears with modified upper hinge eye bolt 12*a*. Similarly, FIG. 11 illustrates a vertical view of the lower gate hinge assembly as it appears with modified lower hinge eye bolt 13*a*. FIG. 12 illustrates how the modified gate finger 14*a* directly bisects gate frame 2.

The alternative constructions of upper hinge eye bolt 12*a*, lower hinge eye bolt 13*a* and gate finger 14*a* are advantageous in many instances because the longer threaded portion on eye bolts 12*a* and 13*a* and gate finger 14*a* allows for a greater margin of error in the gate opening. Further, having the lower hinge eye bolt 13*a* bent at a 55° angle eliminates the drilling of an extra hole in the gate frame at an angle in order to provide the option of hinging the gate on the right or the left. Further, the longer threaded portion allows for a greater margin of error in the gate opening.

The self-adjustability of the gate finger 14*a* is retained with the double compensating bends of 60° while at the same time improving the structural soundness of the latch and the gate. The alternative design is also advantageous from the standpoint that the pre-drilling of gate frame 2 is facilitated because all three holes for the alternative constructions of upper hinge eye bolt 12*a*, lower hinge eye bolt 13*a* and gate finger 14*a* are in the same relative position to the gate corners. It is therefore possible to drill the three holes with one jig, whereas the design described above requires three jigs to position the gate for drilling the three respective holes.

The foregoing description is directed to a preferred construction of my self-closing gate assembly, but it is to be understood that obvious and purely technical variations in design are included within the scope of my invention. The scope of my invention is defined by the claims that follow this description.

The embodiments of the invention in which an exclusive property or privilege is claimed are defined as follows:

1. A self-closing gate construction comprising:

(a) a gate, (b) first and second vertically extending gate posts positioned on each side of the gate, (c) an upper gate hinge extending between the first gate post and one side of the gate, a hinge pin extending upwardly from the hinge and an eye bolt extending through the frame of the gate and fitting over and riding on the hinge pin, (d) a lower gate hinge extending between the first gate post and one side of the gate, a hinge pin extending downwardly from the hinge, and an eye bolt extending through the frame of the gate and fitting on and riding about the hinge pin, (e) a gate latch extending between the second gate post and the side of the gate opposite the side that has the upper and lower gate hinges, (f) the gate being capable of opening in one direction only and not beyond a point where the gate will not self-close, and (g) the upper and lower gate hinges being non vertically aligned with one another, so that the pivot of rotation of the lower hinge is set outwardly in the direction of the gate opening and the lower hinge eye bolt is of greater length than the upper hinge eye bolt, so as to provide universal movement of the gate on the hinge pins and to force the gate upwardly, so to provide a self-closing action by the force of gravity whereby the gate returns to the closed position from the open position.

2. The gate construction of claim 1 wherein the frame of the gate and the two posts are of tubular construction.

3. The gate construction of claim 1, wherein the distance that the lower hinge eye bolt extends from the gate can be adjusted.

4. The gate construction of claim 1, wherein the upper hinge pin is positioned so that it is aligned between the gate post and the gate.

5. The gate construction of claim 2 wherein the gate latch consists of a gate finger connected to the gate and extending toward the gate post, a latch collar, and a pivot lock, the gate finger fitting into the latch collar and being secured by the pivot lock when the gate is in a closed position.

6. The gate construction of claim 5 wherein the gate finger is elongated in shape and is pivotally secured to the gate in a vertical direction so as to accommodate variations in relative height and distance between the gate and the gate post which bears thereon the latching mechanism.

7. The gate construction of claim 6 wherein the gate finger has therein two 60° compensating bends, thereby enabling the gate finger to bisect the gate frame along an axis intersecting with the upper and lower hinge eye bolts.

8. The gate construction of claim 7 wherein the lower hinge eye bolt has therein a 55° bend which enables the lower hinge eye bolt to bisect the gate frame along an axis that intersects with the other side of the gate frame.

* * * * *